US006446270B1

(12) United States Patent
Durr

(10) Patent No.: US 6,446,270 B1
(45) Date of Patent: Sep. 10, 2002

(54) SPORTS HELMET

(76) Inventor: Nicole Durr, 1491 N. Ocean Blvd., Palm Beach, FL (US) 33480

( * ) Notice: Subject to any disclaimer, the term of this patent is extended or adjusted under 35 U.S.C. 154(b) by 0 days.

(21) Appl. No.: 08/994,728

(22) Filed: Dec. 19, 1997

Related U.S. Application Data

(63) Continuation-in-part of application No. 08/615,703, filed on Mar. 13, 1996, now Pat. No. 5,713,082.

(51) Int. Cl.[7] ..... A42B 3/00; B29C 44/06

(52) U.S. Cl. ..... 2/412; 2/425; 264/46.5; 264/46.6

(58) Field of Search ..... 2/410, 411, 412, 2/414, 425, 422, 424, 9; 264/45.4, 45.5, 46.4, 46.5, 46.6, 46.8, 46.9, 273, 328.1

(56) References Cited

U.S. PATENT DOCUMENTS 2,136,473 A * 11/1938 Sloan et al. ..... 2/410
3,992,721 A * 11/1976 Morton ..... 2/410
4,288,268 A * 9/1981 Hartung ..... 2/410
4,615,438 A * 10/1986 Rosenberg et al. ..... 2/425
5,565,155 A * 10/1996 Cheng-Hung ..... 264/46.5
5,609,802 A * 3/1997 Jeng ..... 264/46.5

* cited by examiner

*Primary Examiner*—Amy B. Vanatta
(74) *Attorney, Agent, or Firm*—McHale & Slavin

(57) ABSTRACT

An improved helmet constructed with a rigid shell having a soft outer covering which absorbs impacts and disperses energy thereby protecting the wearer of the helmet, as well as protecting the impacting object. When used for contact sports such as football, this covering is effective in preventing injuries resulting when the helmet is used as a striking object. The covering may be applied in segmented pieces or as a continuous layer around the shell which forms a solid frame-like structure. A method of helmet construction formed from injecting polyurthane into a top vented split mold having a polycarbonate shell positioned within the mold wherein the process sandwiches the shell therebetween to provide an internal and external protective cushion. A face mask can also be covered with soft, durable covering and be mounted in such a manner to allow the covering to act as a shock absorber against sliding of the mask due to external forces.

10 Claims, 5 Drawing Sheets

SPORTS HELMET

This is a C-I-P of application Ser. No. 08/615,703, now U.S. Pat. No. 5,113,082 filed Mar. 13, 1996.

FIELD OF INVENTION

This invention relates to head protection and in particular to an improved sports helmet having an externally cushioned facade providing improved impact protection at a reduced weight.

BACKGROUND OF THE INVENTION

The potential for an individual suffering a head injury while participating in a sporting activity depends upon the type of sport as well as the skill of its participants. High impact sports necessitate the use of the headwear, however, head injuries still occur despite participant skill. Headwear protection must also be capable of withstanding repeated impacts without imparting injury to the individual.

Headwear designed to protect an individual's head from injury is commonly referred to as a helmet. Proper helmet construction cannot be emphasized enough when used in such sports as football. in fact, it is a requirement that high school, college, and professional football players wear a helmet during play. Conventional football helmets include a hard outer casing which encompasses padding as placed against the user's head. As a result, when the user's head impacts a hard object the energy is absorbed and displaced by the padding as it compresses against and between the user's head and the outer casing. However, despite the mandated requirement for helmet use and construction, head injuries are now occurring in notable numbers.

For this reason, numerous helmet manufacturers have patented various helmet designs and materials of construction in an effort to reduce head injury. U.S. Pat. No. 4,300,242 discloses a helmet manufacturing process which consists of textile reinforcement for the use of an impact resistant resin structure. U.S. Pat. No. 5,035,009 discloses a protective helmet and liner which consists of a force absorbing pad structure disposed upon the interior liner of a conventional helmet. U.S. Pat. No. 5,263,203 discloses an inflatable liner that is placed within the inner surface of a helmet and allows an individual to inflate the liner to meet the individual's requirements. U.S. Pat. No. 5,287,562 discloses a helmet construction having an interior padding and associated neckbrace for protection of the individual's head and cervical spine against axial impact forces. The common element in all such helmets is that the outer skeletal shell is constructed of an impact resistant hard plastic shell which operates as an offensive weapon should the individual wearing such a helmet impact another person's body at any portion where the body is unprotected. For instance, should an individual wearing one of the above helmets run into a person's knee the rigid shell may cause irreparable damage as it is uncommon for an individual to wear knee protection. However, should an individual be wearing the protection in the form of foam padding such an impact may be reduced or even eliminated.

In an effort to reduce head injuries, various protection groups are established for evaluating the safety of helmets and related accessories. The most notable is the nonprofit group National Operating Committee on Standards for Athletic Equipment, NOCSAE. The members of NOCSAE include the American College Health Association, American Orthopaedic Society for Sports Medicine, Athletic Equipment Managers' Association, National Association of Secondary School Principals, National Athletic Equipment Reconditioners' Association, National Athletic Trainers Association, National High School Athletic Coaches Association, Sporting Goods Manufacturers' Association and the College Football Association. NOCSAE was formed in 1969 in response to the need for a performance test standard for football helmets. Since then, standards have been developed for football, baseball, softball and lacrosse, with additional standards for other equipment currently being evaluated.

Since the 1960's media technology has increased coverage to bring about a greater exposure to sports. This in turn caused athletes to become involved at a younger age where they trained to perform more aggressively with goals such as athletic scholarships or lucrative professional contracts after college. Unfortunately, with the increased attention and involvement, serious injuries also became more prevalent. This was particularly evident in the sport of football where there were 32 fatalities in 1968 directly due to participation in organized competition, plus 4 more fatalities resulting from sandlot play.

Several problems confronted the NOCSAE, and other advocates, in their attempt to reduce football injuries. One of the problems in reducing injuries was the increased use of the head as the initial point of contact in blocking and tackling. It is a continuing concern that any improvements to equipment might lead to more and harder hits involving the head and the helmet. In other words, a competitive player—when given a helmet offering more internal protection for himself—might be more inclined to hit his opponent harder with this helmet. Safer internal padding results in a potentially more violent weapon in the hands of the user, particularly because of the hard outer casing being applied now with an even greater force.

While a downturn in head injury fatalities has been observed over the years due to the use of helmets, death and disabilities still continue to occur. The rule makers f or football (e.g. the NCAA and NFL) have recognized that the helmet and face mask combination now play a dual role: while it reduced serious injuries, it has invited the use of the head as an offensive weapon. In 1976, rule-making committees were responsible for initiating changes which prohibited initial contact of the head in blocking and tackling (e.g. no "spearing" rules). While these rules have helped to reduce injuries, a rule in itself cannot prevent injury and/or maiming of a player. Such a rule can only invoke a yardage penalty, a fine, or at worst a suspension of a player. The injury and associated damage, however, will have still occurred to the victim player.

In response, groups such as the NOCSAE, NCAA, and NFL have also encouraged the application of warning labels on helmets and other equipment which warn the user of the potential dangers involved with playing a certain sport. Moreover, extra training regarding injury free methods of carrying the ball, blocking, and tackling have also been practiced. Together, such efforts to educate the players and coaches can only go so far to prevent injuries. If a piece of equipment, such as the helmet and/or face mask, continue to present a hard and injurious surface, then the injuries will invariably continue to occur as this surface is naturally brought into contact with other helmets, attached necks, and fragile body parts. Other contact sports such as hockey, lacrosse, and baseball will also continue to sustain such injuries under the present state of the equipment for similar reasons mentioned above.

Accordingly, a helmet is needed which provides superior comfort, padding, and weight advantages for the user, while simultaneously offering more resilient external surfaces for contact with opposing objects. This resilient external surface will, in itself, absorb energy and yet offer a softer impact surface. Hence, all players are protected from injurious impacts through the use of such equipment.

SUMMARY OF THE INVENTION

The present invention teaches an improved sports helmet which incorporates a unique energy absorbent material secured to the outer surface of a rigid shell. A face mask can also be utilized that incorporates the energy absorbent material for either coating of the mask or limiting movement of the mask. The shell and material coating provides for a helmet that can be less than half the weight of a solid plastic shell helmet.

The helmet can be made of a conventional shape for its desired application such as football, lacrosse, and hockey. The energy absorbent material is preferably a memory rubber such as vinyl nitrile sponge (VNS) being a combination of thermoplastic poly vinyl chloride and synthetic elastomer nitrile. The VNS covering can be further coated providing abrasion resistance and allowing for cosmetic effects. In this manner, the size and shape of the helmet can remain the same. Coloring of the material maintains an appearance identical to conventional helmet design.

An alternative to the interlocking pieces of energy absorbent material is an injection molding process having a proprietary flexible polyurethane foam that provides a helmet of uniform consistency. The injection process requires the placement of a flexible polycarbonate shell within a split mold in such a manner to allow the foam material to cure around each side of the shell wherein a the padding is evenly distributed on each side surface of the liner.

The helmet construction involves the placement of a speciality shaped flexible liner having an inner form-fitting surface to be first positioned over a rigid head-shaped base. The rigid base supports the liner during the injection molding process in one plane with the split mold housing having provisions for holding the liner from moving when the split mold is closed. The proper spacing of the liner to the mold is made possible by use of spacing posts which extend from the outer surface of the liner a predetermined distance causing a spacial distance between the shell and liner. It is noted that the liner is designed to remain flexible for insertion and removal purposes. The base, liner, and split mold are reusable.

In production, the base, liner, and polycarbonate shell are placed as a unit into the preformed split mold housing. The internal cavity of the split mold is contoured to follow the outer shape of a desired protective helmet. After insertion, the liner is stabilized into a fixed position by use of positioning rods which are inserted through the exterior walls of the mold. The rods extend through the rigid shell and flexible liner to abut the head-shaped support base. The positioning rods ensure that, during the molding process, the liner and rigid shell remain in a desired orientation within the internal cavity of the mold.

A predetermined amount of polyurethane is then injected into the mold to fill the area bounded by the liner and the interior cavity of the mold. The spacing posts that separate the shell from the liner allow the injected polyurethane to flow around each side surface of the shell. The rigid shell is perforated allowing the polyurethane to pass through the shell to provide an inseparable attachment between the inner and outer surfaces.

Once the polyurethane is cured, the split mold is opened and the base, liner, and newly-formed helmet are removed, collectively, from the mold. The liner and helmet are then simultaneously separated from the rigid base. The liner is then peeled out from within the interior of helmet. As with the first embodiment the finished helmet effectively cushions impacts both inside and outside the helmet and exceeds all current safety standards for helmet manufacturing.

The outer surface of the helmet is preferably coated with a Teflon coating which provides a high gloss smooth finish as well as provides a slick surface that inhibits rotational acceleration should the helmet impact another surface.

The energy absorbing properties of the helmet provide protection to the wearer and further operate to reduce the impact ability of the helmet when contacting another object. In this manner if a helmet wearing participant struck an unprotected area of another player, the helmet provides a level of protection in the form of padding to both players. For instance, if a football player wearing a padded helmet strikes the unprotected knee of another player, the material will absorb a portion of the shock lessening damage to the knee. This energy absorbing properties is doubled when two players butt heads as each player having the coating helps to absorb the impact.

Accordingly, it is an objective of the present invention to provide a helmet with a soft, energy absorbent covering on its outer surfaces.

Still another objective of the present invention to provide a helmet that is lighter and safer than the football helmets currently employed.

It is a related objective of the present invention to provide a layered protection scheme for a user's head which includes a hard helmet shell with a layer of soft, energy absorbent covering on its inner and outer surface.

It is still a further objective of the present invention to provide a face mask for a helmet which incorporates soft, energy absorbent material along its outer surfaces.

It is yet another objective of the present invention to provide a helmet with a soft, energy absorbent material molded entirely around the inner and outer surfaces of a hard helmet shell.

It is a related objective of the present invention to provide a helmet with a soft, energy absorbent material molded around an inner web of structural support material.

It is also an objective of the instant invention to disclose a process of manufacturing a padded helmet having a soft, energy absorbing covering on its outer and inner surfaces with a rigid shell formed integral therebetween.

Another objective of the instant invention is to disclose a helmet that can be inexpensively produced in mass quantity providing an affordable helmet for use by the general public.

Yet still another objective of the instant invention is to disclose a helmet that is has a malleable surface which can be coated with an impact resistant coating that will prevent rotational acceleration by providing a slick surface.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
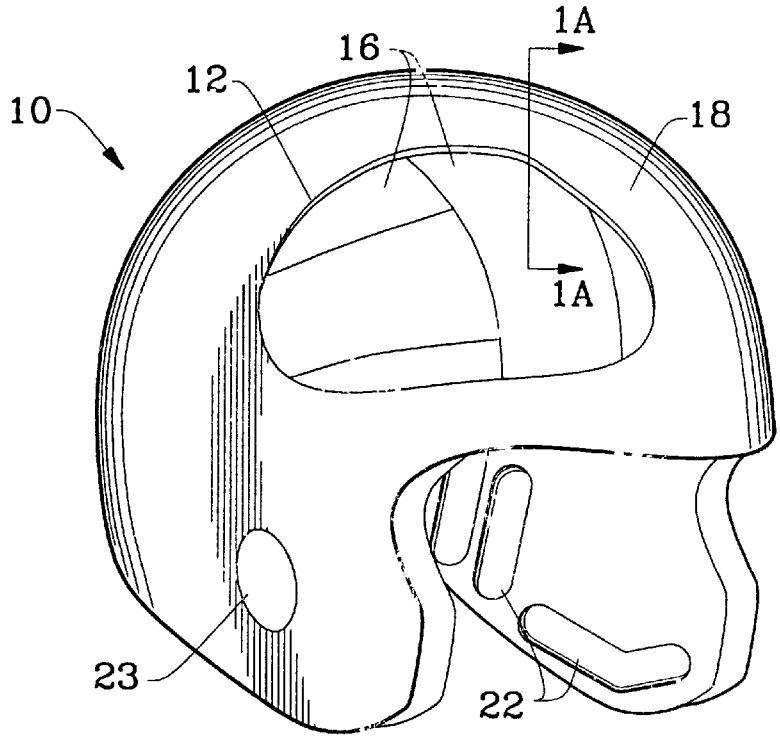
FIG. 1 is a front view of a helmet with a cutout of the helmet shell.

Referring to FIG. 1, a helmet 10 is illustrated having a cutaway 12 which shows the inner structure of the sponge-type padding that has been added to the outside of a hard helmet shell. In this embodiment, the padding has been added in segmented pieces 16 due to the spherical nature of the helmet. Such padding materials might include ½ inch thick Rubatex brand VNS which is cut to shape and bonded to the outside of a lightweight polycarbonate helmet shell with contact cement (e.g. Weldwood by DAP). A final coating of urethane (e.g. Flexane liquid by Devcon) has been applied to seal the gaps/seams formed by the segmented pieces. Accordingly, the urethane coating makes the helmet smooth in appearance and cosmetically more appealing. The urethane also proves to be an effective surface for resisting abrasions and for providing environmental resistance to elements such as water, snow, sunlight, etc. Any necessary cutouts, like an earhole 23, could then be added to the helmet through the various layers.

Figure 1A:
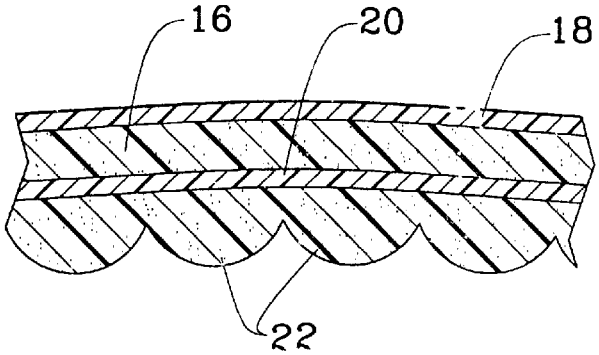
FIG. 1*a* is a cross sectional view taken along lines AA of FIG. 1.

Referring now to FIG. 1A, a cross-sectional view of the helmet along cut A—A is shown. This view reveals the hard inner shell 20 as bounded on the top by padding layer 16. The urethane layer 18 then exists on top of padding layer 16. The inner part of the shell is lined with a foam (or sponge) padding 22 which conforms to the shape of a users head and provides breathable cushioning between the user's head and the hard central shell 20. As shown, this layer usually consists of a series of pillow-like pads, which are strategically placed and aligned for the comfort of the user.

Figure 2:
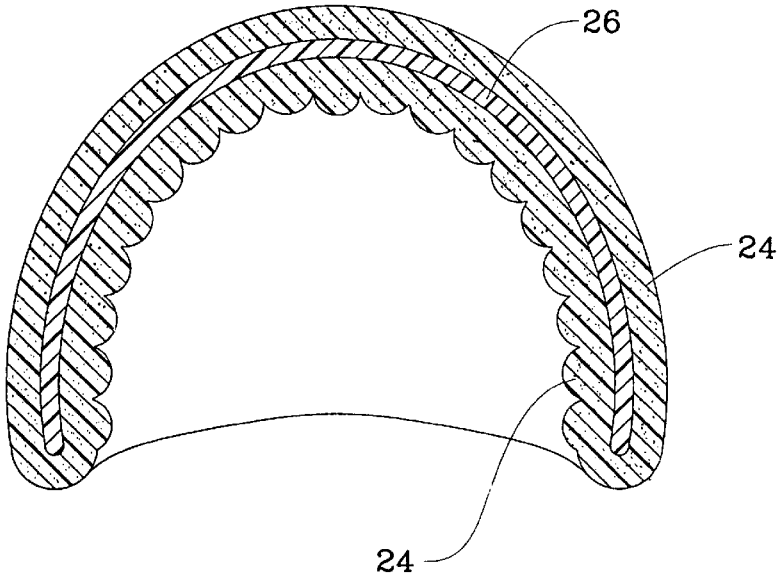
FIG. 2 is a cross sectional view of the shell.

Referring now to FIG. 2, a cross-sectional view of a helmet is shown whereby the VNS foam has been formed to encapsulate the inside and outside of the hard inner shell 26. This might be accomplished via a molding process or coating process around the inner helmet shell.

Figure 3:
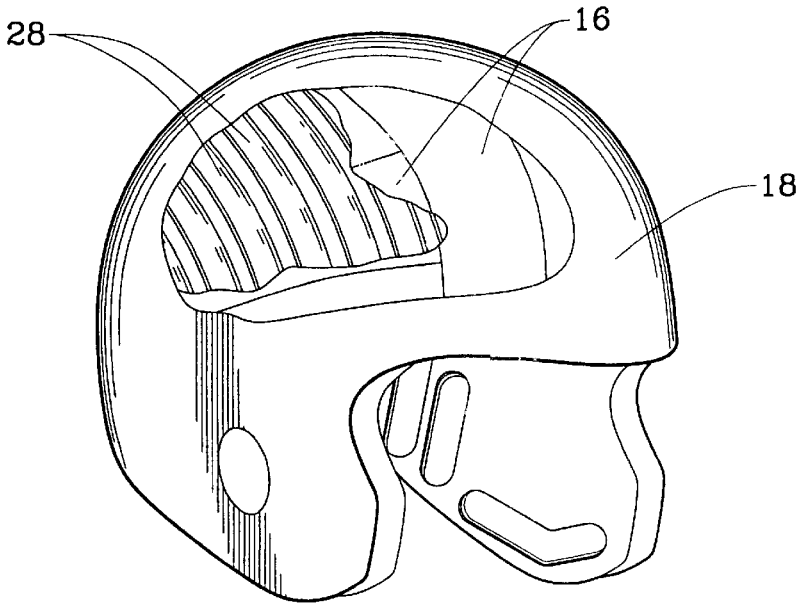
FIG. 3 is a perspective view of a helmet illustrating the layering of materials.

Referring now to FIG. 3, an alternative to the hard inner shell is proposed which might include a rigid frame-like structure 28 instead of a solid shell. As illustrated, this frame consists of a series of slats which are strategically attached to each other to provide structural rigidity, while also providing a lighter weight structure than a solid shell. The frame provides an attachment surface for the outer layer padding pieces 16 which can be cemented onto the outer surface of the structure 28. As before, the entire outer surface of the conformed pieces 16 is covered with a smooth urethane coating 18. Alternatively, like FIG. 2, the structural frame might be encapsulated on the inside and outside with VNS or another suitable padding material.

Figure 6:
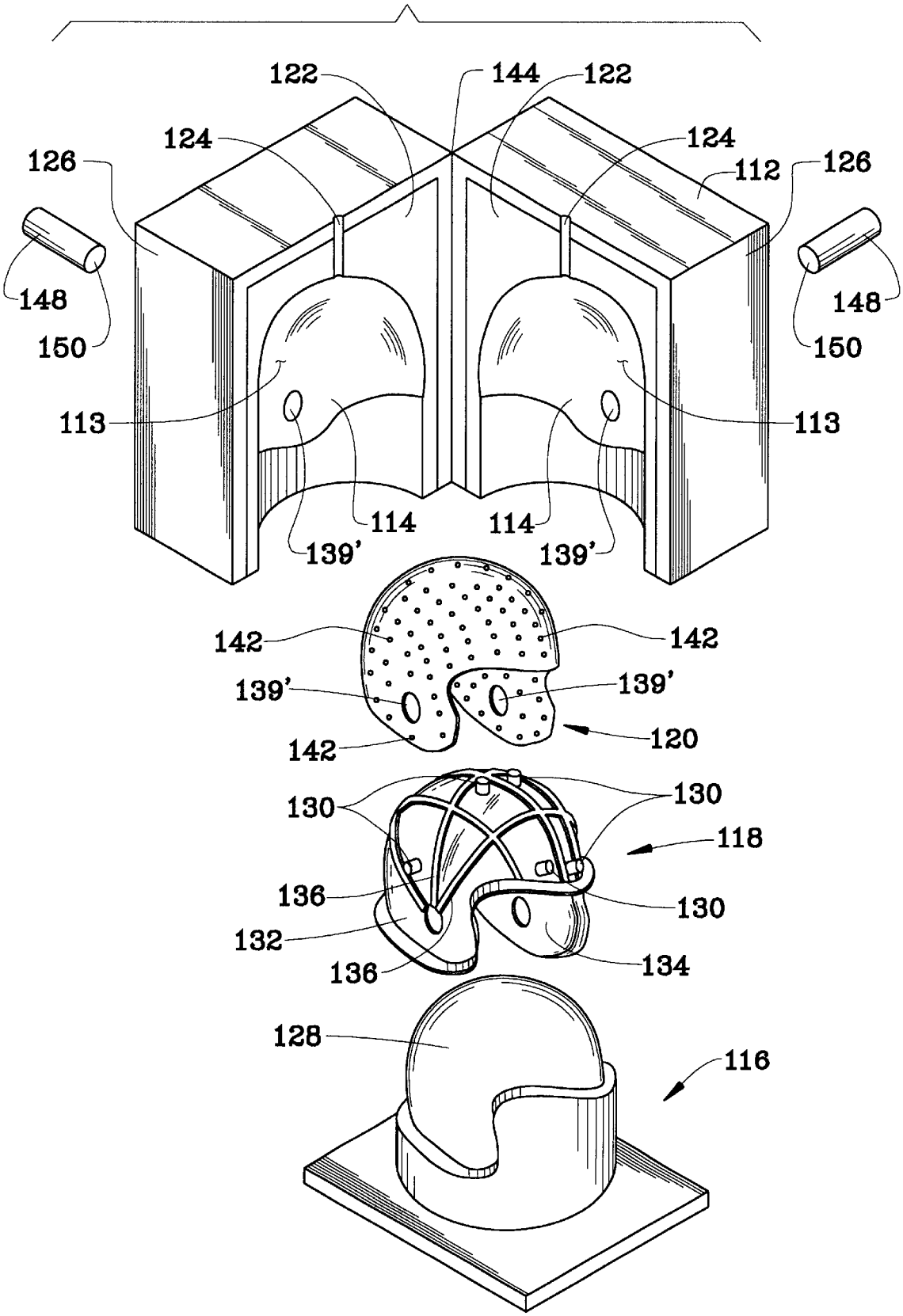
FIG. 6 is an exploded view of the components used cooperatively to form the injection molded embodiment of the present invention.
Figure 7:
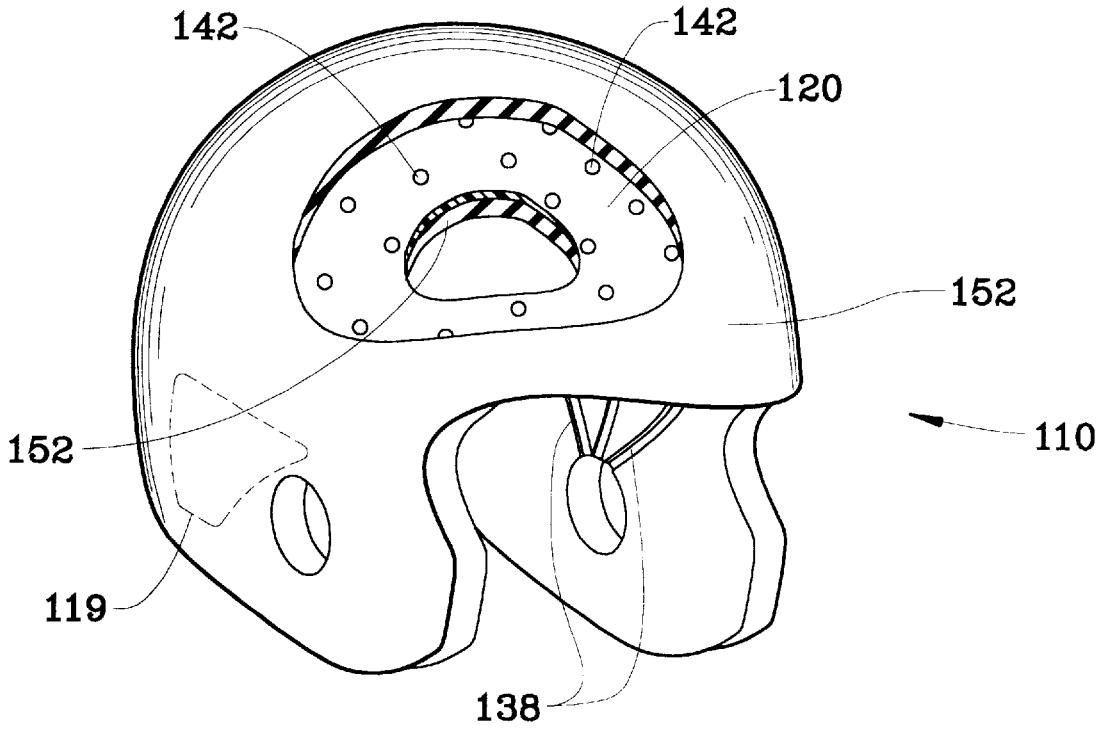
FIG. 7 is a partially cut away pictorial view of the protective helmet formed with the comonents shown of FIG. 6.

Referring now to FIGS. 6 and 7, an alternate embodiment of the instant invention is shown of which several steps are involved in making the injection molded embodiment of the helmet 110. To make this helmet 110, a collection of pieces is assembled in a predetermined manner to selectively form a split mold 112. As will be described more fully, below, the molding process to includes: a rigid support base 116, a flexible liner 118, a rigid shell 120, and an outer mold 122. The pieces cooperate to form a sealed injection assembly 114. The boundaries of the injection chamber 114 assimilate the protective helmet 110 to be formed.

Once the pieces are arranged to form the sealed cabinet 112, liquid polyurethane is forced into the injection chamber 114 through an injection conduit 124 that extends between injection chamber 114 and the cabinet exterior 126. As it flows into the injection chamber 114, the polyurethane expands to take the shape of the injection chamber 114 boundaries.

The flexible polyurethane foam is produced by reacting an organic polyisocyanate such as aliphatic cycloaliphatic, araliphatic, aromatic, or heterocyclic polyisocyanate.

The foam material is used to encapsulate the hard inner shell. This foam material provides an energy absorbing layer between the head of the wearer and the hard inner shell and between the hard inner shell and the exterior surface of the helmet assembly. This helmet assembly collectively protects both the wearer's and other players who may be impacted by the helmet during play.

The foam material used during prototype development is a polyurethane foam custom blended by Plast-O-Meric U.S., Inc. Of Sussex, Wis. and designated FF-3149XA. This foam is supplied in two parts called ISO and POLY. Metered amounts of ISO and POLY (typically 48 parts ISO to 100 parts POLY) are pumped under pressure to a blending nozzle and fed directly into the bottom of a top-vented mold. The foaming is a result of chemical reactions that begin when ISO meets POLY. These chemical reactions cause the mixture to heat up, foam and expand inside the mold cavity, and finally harden. As the mixture heats, foams, rises and finally hardens inside the mold air is being forced out through the vent holes as the cavity fills with foam. Because the vent holes are relatively small (typically 0.1 inch in diameter) a positive back pressure develops inside the mold. This back pressure is important to insure a homogeneous foam density inside the mold and for proper skin formation. For example, in our prototype helmets the molded foam density is 2 to 3 times the free-rise foam density.

Because this is a dynamic process that takes only about 20 seconds, it is important to customize the POLY blend to the mold and vents being used. The ISO used in this application is a special quasi-prepolymer made for high peformance foams.

The ISO is typically an organic polyisocyanate such as aliphatic, cycloaliphatic araliphatic, aromatic or heterocyclic polyisocyanate.

The POLY is typically a blend of polyether polyols 93% chain extenders 4.55 tertiary amine catalysts 1%, organic metal compounds, emulsifiers and foam stabilizers, and blowing agents including HFC 13*a*, HFC 245 1% and water 0.5%.

The blend of polyether polyols typically include: polyoxypropylene diols, triols and tetrols; ethylene oxide capped diols, triols and tetrols; random and block polymers of diols, triols, and tetrols containing both ethylene and propylene oxides; copolymer polyols containing stable dispersions of solids; polyester polyols including ethylene glycol adipates, cross-linked diethylene glycol adipates, cross-linked 1,3-butylene glycol phthalate adipates, linear diethylene glycol adipates, 1,4-butanedial adipates, cross-linked dipropylene glycol phthalate adipates.

The chain extenders typically include: 1,4-butane diol; diethanolamine, triethanolamine; ethylene glycol; diethylene glycol, triethylene glycol; 1,2-butane diol, 1,3-butane diol; 1,2-pentane diol, 1,4-pentane diol, 1,5-pentane diol; 1,6 hexane diol; glycerol.

Tertiary amine catalysts typically include; triethylamine, tributylamine, N-methyl-morpholine, 1,4 diazabicyclo-(2,2,2)-octane, bis-(N,N-diethylaminoethyl) adipate.

Organic metal compounds including: tin (II)-salts of carboxylic acids, dialkytin salts of carboxylic acids.

Emulsifiers and foam stabilizers including: sodium salts of castor oil sulfonates, diethanolamine stearate, water-soluble polyether siloxanes.

Blowing agents including: water, HFC 134*a*, HFC 245, acetone, methylene chloride, cyclo pentane.

The polyurethane is allowed to cure, forming the protective helmet 110 of the present invention. Once the polyurethane has cured, the cabinet 112 is opened and the helmet 110, flexible liner 118, and rigid base 116 are removed from the outer mold 122. The helmet 110 and flexible liner 118 are then removed, as a unit, from the rigid base 116. The flexible liner 118 is, in turn, peeled away from the interior of the helmet 110. The newly-formed helmet 110 is prepared for use and the flexible liner 118 is retained for to mold additional helmets. A flow diagram of this process The support base 116 is essentially an non-compressible post that prevents deformation of the flexible liner 118 during the molding process. As shown in FIG. 6, the support base 116 is shaped to follow the outer contours of an individual's head. The support base 116 has a smooth exterior surface 128 that advantageously allows easy separation of the support base 116 and the flexible liner 118. Although the support base 116 is preferably milled from a solid piece of wood or plastic, any material that will support the flexible liner during the molding process may be used.

The flexible liner 118 is formed by placing the support base 116 into a liner mold, not shown. Inserting the base 116 into the liner mold produces a liner-shaped void bounded by the exterior surface 128 of the support base 116 and the interior of the liner mold. Rubber or the like flexible material is injected into the liner mold to fill the liner-shaped void. The rubber is allowed to cure, forming the flexible liner shown in FIG. 6. A collection of spacing posts 130 extend orthogonally from the exterior surface 132 of the flexible liner 118. The interior surface 134 of the flexible liner 118 is smooth to advantageously allow the liner to slide easily on and off the support base 116. The exterior surface 132 of the liner also includes a network of ribs 136. As shown in FIG. 7, the ribs 136 produce grooves or channels 138 within the interior surface 140 of the helmet 110. The channels 138 allow for increased air flow between the interior surface of the helmet 110 and the head of the individual who wears the helmet. The channels 138 also add a degree of flexibility to the helmet 110 without reducing strength. The liner 118 also includes ear holes 139 that double as positioning bores during the helmet forming process.

The rigid shell 120 is formed by injecting a polycarbonate material in between corresponding halves of a two-piece mold, not shown. Together, the mold halves form a shell-shaped cavity. The polycarbonate is injected into the shell-shaped cavity and allowed to cure therein. As the polycarbonate cures, it forms the rigid shell 120. After the polycarbonate curing process is complete, flow-through perforations 142 may be drilled into the shell 120, and the shell is ready for use. It is noted that the mold may have the perforations preformed to eliminate the step of drilling. Simular to the flexible liner, the rigid shell 120 includes ear holes 139' that double as positioning bores during the helmet forming process. The rigid shell 120 thus formed preferably has a uniform thickness of approximately 0.125 inches. However, this thickness may be modified in accordance with the environment in which the helmet 110 will be used.

After the pieces are formed, the helmet forming process can begin. The flexible liner 118 is placed snugly onto the support base 116, and the rigid shell 120 is, in turn, placed onto the flexible liner. The spacing posts 130 maintain a desired distance between the rigid shell 120 and the exterior surface of the flexible liner 118.

An inflatable bladder 119 may be positioned along the outer surface of the shell. The bladder operates to distance the liner, to be formed, from the shell providing a custom adjustment to the wearer's head. The bladder may be formed from any type of flexible material although a thin rubber formed bladder is perferred. A detachable low pressure air pump will inflate the bladder once the helmet is placed on the individual for custom fitting.

The outer mold 122 is then placed around nested base 116, liner 118, and shell 120 and hinged shut. In this position, the ear holes 139,139',139" are aligned, allowing insertion of positioning rods 148. The positioning rods 148 extend through the cabinet exterior 126, pass through the rigid shell ear holes 139', and continue through the flexible liner ear holes 139. A distal end of each of the positioning rods 148 abuts the exterior surface 128 of the rigid base. The positioning rods 148 ensure that the flexible liner 118 and rigid shell 120 remain stationary during the helmet forming process. Once the positioning rods are in place, the outer mold 122 is clamped shut and polyurethane is injected under pressure into the injection chamber through the injection conduit 124. Preferably, the polyurethane has a foam free rinse density of 10.5 pcf, a foam molded density of 23–27 pcf and, a foam molded hardness of 35–45 A SHORE. The polyurethane is a blend of a quasiprepolymer with a blend of polyether polyoys. More specifically, the polyurethane is formed from two components: a modified MDI quasiprepolymer and a blend of polyether polyoys. Materials are inserted by use of HCF 134 A as a blowing agent.

The polyurethane expands as it flows into the injection chamber 114. As the polyurethane expands, it flows through the rigid shell perforations 142 and completely engulfs the entire rigid shell 120. As a result, material on both sides of the shell 120 bonds together.

As the polyurethane cures, the outer mold 122, base 116, liner 118, and shell 120 are rotated, as a unit, to ensure even distribution of the injected polyurethane. During the rotation, the polyurethane solidifies to form the protective helmet 110. As shown in FIG. 7, once the polyurethane has cured completely, the rigid shell 120 is permanently concealed within the helmet 110, increasing the structural integrity thereof.

Once the helmet 110 is formed, the outer mold 122 is opened and the support base 116, liner 118, and newly-formed helmet 110 are removed, collectively, therefrom. The helmet 110 and flexible liner 118 are then separated, as a unit, from the rigid base 116. The flexible liner 118 is then peeled away from the interior surface 140 of the helmet 110.

The flexible liner 118 may be advantageously stored to form additional helmets.

Figure 4:
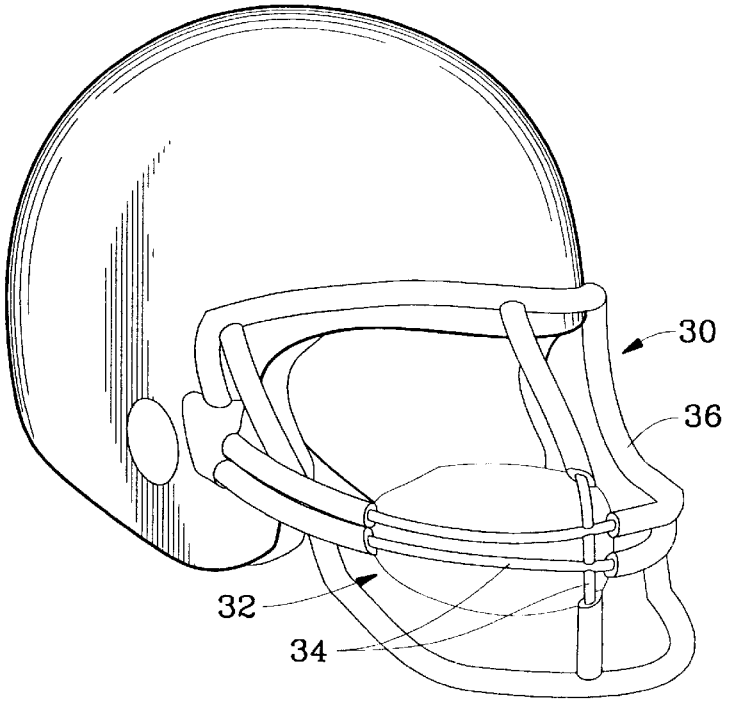
FIG. 4 is a partial view of a face mask.

Many sports also require a face mask to be attached to the helmet in order to protect the wearer's face from invading objects such as another helmet, a playing stick, an opponents hands, or a ball. The face mask is usually cast with thin cross sections as a single piece and hardened using high strength alloys (e.g. titanium, 4140 steel, 440 stainless steel, etc.) Given the dangers posed by the hard exterior surface of this face mask, it too could benefit from being covered with VNS or a similar type elastomer material. Referring now to FIG. 4, a covered face mask grid 30 is shown with a cutaway 32 to the bare grid wires 34. As before, this soft exterior covering 36 might be adhered in pieces to the grid 34, or alternatively might be molded to encapsulate the entire grid. Accordingly, the elastomer cushions the impact against the mask and reduces injuries to the players and opponents.

Other accessories which could also benefit from application of VNS and like materials include such items as the chin strap which sometimes has a cup with a hard outer edge. VNS could also be used to construct a headliner with an inflatable insert which would add to the cushioning effect and provide for an optimum fit of the helmet against the user's head.

Figure 5:
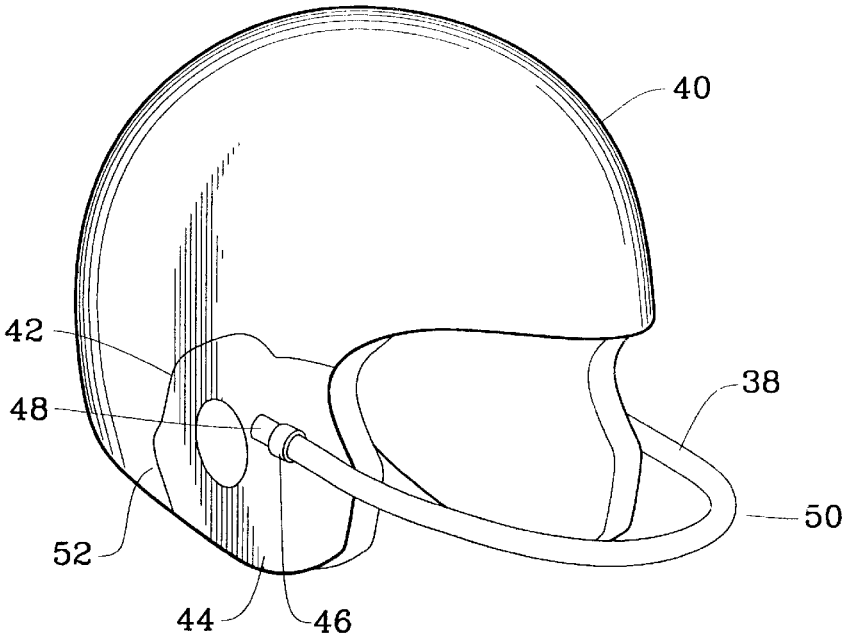
FIG. 5 is a side view of a helmet detailing the face guard attachment.

In yet another embodiment, FIG. 5 shows a single bar face mask 38 mounted on a helmet 40 wherein cutout 42 shows the hard inner shell 44 having an extruded, slidable mount 46 in its side. This mount 46 slidably receives the back end 48 of the mask so that when pressure is exerted on the face mask (as shown by arrow 50), the mask is slidably retained by mount 46, but is allowed to slide backwards into the surrounding foam layering 52. This will produce a cushioning effect for both the player wearing the helmet and provide a softer impact response from the striking object. Such a slidable mounting arrangement might be used in lieu of, or in addition to, the aforementioned padding as added to the exterior of the face mask.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. A method of making a protective helmet comprising the steps of:

a) forming a topvented outer mold having an interior surface that bounds a chamber sized and shaped to assimilate a protective helmet outer surface, said outer mold disposed within a split mold housing;

b) forming a contoured rigid shell member, said shell member sized to fit within said outer mold;

c) forming a flexible liner shaped to follow the contours of an inner surface of said shellmember, said flexible liner having spacers extending from an outer surface thereof;

d) temporarily securing said liner and said shell member in a predetermined orientation within said outer mold;

e) injecting a predetermined amount of polyurethane into said mold, said predetermined amount being great enough to surround said shell member;

f) allowing said polyurethane to cure, forming a helmet sandwiched between said flexible liner and said outer mold interior surface;

g) removing said liner and said helmet from said mold; and separating said liner and said helmet.

2. The method of making a protective helmet of claim 1, including the steps of:

a) forming a rigid base having an exterior surface shaped to assimilate the outer contours of an individual's head; and b) placing said flexible liner onto said base.

3. The method of making a protective helmet of claim 1, wherein said liner and said at least one shell member are secured in said predetermined orientation by at least one rod inserted there into.

4. The method of making a protective helmet of claim 1 wherein said at least one shell member includes perforations sized and positioned to allow said polyurethane to flow therethrough.

5. The method of making a protective helmet of claim 1, wherein vent hole provides a positive back pressure inside said mold to insure a homogeneous foam density mixture within said mold.

6. The method of making a protective helmet of claim 1, wherein the polyurethane of step (e) is produced by reacting approximately 48 parts ISO to approximately 100 parts POLY pumped under pressure to a blending nozzle and fed directly into the bottom of said top-vented mold.

7. The method of making a protective helmet of claim 6, wherein said ISO is from the organic polyisocyanate group aliphatic, cycloaliphatic araliphatic, aromatic or heterocyclic polyisocyanate.

8. The method of making a protective helmet of claim 6, wherein said POLY is a blend of polyether polyols 93% chain extenders 4.55 tertiary amine catalysts 1%, organic metal compounds, emulsifiers and foam stabilizers, and blowing agents.

9. The method of making a protective helmet of claim 8, wherein said blowing agents includes HFC 134a.

10. The method of making a protective helmet of claim 1, including an inflatable bladder positioned along the outer surface of the shell.

* * * * *